US005283399A

United States Patent [19]

Fujino et al.

[11] Patent Number: 5,283,399

[45] Date of Patent: Feb. 1, 1994

[54] GROUP CONTROL OF ELEVATOR SYSTEM IMPROVEMENT MEASURES

[75] Inventors: Atsuya Fujino, Hitachi; Hiromi Inaba, Katsuta; Toshimitsu Tobita, Hitachi; Kenzi Yoneda; Hiroaki Yamani, both of Katsuta, all of Japan

[73] Assignee: Hitachi, Ltd., Tokyo, Japan

[21] Appl. No.: 788,320

[22] Filed: Nov. 5, 1991

[30] Foreign Application Priority Data

Nov. 5, 1990 [JP] Japan ..... 2-297323

[51] Int. Cl.[5] ..... B66B 1/20; B66B 3/00

[52] U.S. Cl. ..... 187/124; 187/133

[58] Field of Search ..... 187/127, 124, 128, 129, 187/133

[56] References Cited

U.S. PATENT DOCUMENTS 4,760,896 8/1988 Yamaguchi ..... 187/124

4,947,965 8/1990 Kuzunuki et al. ..... 187/127

*Primary Examiner*—Steven L. Stephan

*Assistant Examiner*—Robert Nappi

*Attorney, Agent, or Firm*—Antonelli, Terry, Stout & Kraus

[57] ABSTRACT

The invention relates to a group-control elevator system for controlling an operation of elevators a group by control data. The group-control elevator system stores a plurality of improvement measures corresponding to plural inconvenience phenomenon including a long average wait time for the plurality of elevators. The inconvenience phenomenon is detected from actual data of the elevators, and the actual data is obtained by actual elevator operation and one improvement measure is selected from the improvement measures in accordance with the detected inconvenience phenomenon.

16 Claims, 15 Drawing Sheets

FIG. 4

9

| MODE | LEVEL | PHENOMENON NAME |
|---|---|---|
| OFFICE-GOING HOUR | 3 | SHORT SHIPMENT |
| | 2 | LONG AVERAGE WAITING TIME |
| | 1 | OVER LAPPED OPERATION |
| NORMAL | 5 | LONG AVERAGE WAITING TIME |
| | ⋮ | ⋮ |
| ⋮ | ⋮ | ⋮ |

FIG. 5

10

| PHENOMENON | | IMPROVEMENT MEASURES | ON/OFF | IMPLEMENTATION ATTRIBUTE | | |
|---|---|---|---|---|---|---|
| MODE | LEVEL | | | IMPLE-MENTED | POSSIBLE | IM-POSSIBLE |
| OFFICE-GOING HOUR | ⋮ | ⋮ | | | | |
| | 1 | IMVALIDATION OF DOOR CLOSING BUTTON | Y | | | ○ |
| | | STOP ONCE AT STARTING FLOOR | Y | ○ | | |
| | | EXTENSION OF START RESTRICTION TIMING | N | | ○ | |
| ⋮ | ⋮ | ⋮ | | | | |

9···PHENOMENON LEVEL TABLE
10···IMPROVEMENT MEASURE TABLE

FIG. 10

10

| PHENOMENON | | IMPROVEMENT MEASURES | ON/OFF | IMPLEMENTATION ATTRIBUTE | | | |
|---|---|---|---|---|---|---|---|
| MODE | LEVEL | | | IMPLE-MENTED | POSSIBLE | INQUIRY | IMPOSSIBLE |
| OFFICE-GOING HOUR | ... | ... | | | | | |
| | 1 | IMVALIDATION OF DOOR CLOSING BUTTON | Y | | | | ○ |
| | | STOP ONCE AT STARTING FLOOR | Y | | | ○ | |
| | | EXTENSION OF START RESTRICTION TIMING | N | | ○ | | |
| ... | ... | ... | | | | | |

FIG. 16

10

| PHENOMENON | | IMPROVEMENT MEASURES | ON/OFF | IMPLEMENTATION ATTRIBUTE | | | | REPORT ATTRIBUTE | |
|---|---|---|---|---|---|---|---|---|---|
| MODE | LEVEL | | | IMPLEMENTED | POSSIBLE | INQUIRY | IMPOSSIBLE | NOT REQUIRED | REQUIRED |
| OFFICE-GOING HOUR | ... | ... | | | | | | | |
| | 1 | IMVALIDATION OF DOOR CLOSING BUTTON | Y | | | | ○ | ○ | |
| | | STOP ONCE AT STARTING FLOOR | Y | | | ○ | | ○ | |
| | | EXTENSION OF START RESTRICTION TIMING | N | | ○ | | | | ○ |
| ... | ... | ... | | | | | | | |

GROUP CONTROL OF ELEVATOR SYSTEM IMPROVEMENT MEASURES

BACKGROUND OF THE INVENTION

The present invention relates to a group-controlled elevator system, and more particularly to a group-controlled elevator system with the function of adapting operation of elevators to a utilization state of the elevators peculiar to each building.

In the group control of elevators, a "prompt reservation system" is generally used in which a utilization state of elevator cars is predicted and compared to determine an elevator car for a guest who has arrived at an elevator hall so that assignment and reservation guidance of the elevator are made to the guest. However, since the utilization state of elevator cars is changed momently and the change of the utilization state can not be predicted perfectly, it is impossible to make the assignment so that every assignment is "optimum" or a desire of the guest is fully satisfied. Origins or causes which give rise to an assignment which can not satisfy the desire of the guest are considered as follows:

(1) when unpredictable abrupt demand occurs;

(2) when the desire of the guest is not satisfied by any assignment since a transportation capability of the elevators is lacking;

(3) when there is a problem in a prediction method, a control method, various setting conditions or the like; and (4) when there is a problem in a utilization method of elevators by guests.

When assignment which can not satisfy a desire of the guests is repeated due to the origin or cause (3) of the above-described origins, a claim (or demand, desire, proposition, opinion, request, question, interrogation, indication, advice, warning, disaffection, complaint, disrepute, inconvenience or the like, and hereinafter referred to as a claim generically) relating to operation of the elevator cars, for example a claim that some guests can not get in an elevator car, that is, short shipment, or a waiting time is long, is made on a design and maintenance department from the guest (a mere user of the elevator) or user (owner of the building). Further, even if no claim is made actually, there is a phenomenon that the operation efficiency of the elevator cars is reduced temporarily, and hence a group-controlled elevator system in which phenomena causing the claim and reduction of the operation efficiency do not occur is desired.

Accordingly, for example, a method as disclosed in Japanese Patent Unexamined Publication No. 58-52162 in which traffic flow data peculiar to each building is learned and the data is used to correct prediction parameters or control parameters or a method as disclosed in Japanese Patent Unexamined Publication Nos. 63-247278 and 64-22772 in which when assignment fails, a control rule used for the assignment is corrected or removed are heretofore known. These methods are to adapt the group-controlled elevator system to a building in which the system is installed, while since a correction scope of the system is limited, all origins or causes can not be improved.

Thus, when these methods are used but the claim phenomenon is not improved, a person participating in design and maintenance investigates an actual operation state of the elevator in the building and estimates an origin of the claim phenomenon to make a countermeasure therefor so that the operation of the elevator is improved. Heretofore, in order to reduce such work of the person, Japanese Patent Unexamined Publication No. 60-258076, for example, discloses a maintenance apparatus which produces data required by the maintenance person, and Japanese Patent Unexamined Publication No. 62-100384 discloses a trouble diagnostic apparatus which records data in a failure or abnormality and facilitates an investigation of an origin by the maintenance person. Further, as a result of the investigation of the actual operation state of the elevator, there is a case that the claim phenomenon is caused by the above-described reason (4). In such a case, education of the utilization method of the elevator is made through an administrative person of a building.

On the other hand, as a prior art in which a knowledge processing method is applied to the group-controlled elevator system, a technique disclosed in Japanese Patent Unexamined Publication No. 63-242873 as well as the above-mentioned Publication No. 64-22772 is known in which a rule base is used to predict and estimate an operation state of the elevator upon the assignment. [Problems that the Invention is to Solve]

As described above, since the conventional automatic correction technique possesses limited correction scope, the correction technique can not cope with all claim phenomena and operation efficiency reduction and it is necessary to correct the claim phenomena and operation efficiency reduction exceeding the correction scope by the person.

Further, there is a problem that the improvement of the claim phenomenon by means of the investigation of the actual operation state in the building is a large burden such as labor, time and expense to the side participating in design and maintenance of the elevator and the building administrative side.

SUMMARY OF THE INVENTION

It is an object of the present invention to provide a group-controlled elevator system capable of preventing occurrence of a claim from a user and occurrence of operation efficiency reduction phenomenon.

In order to achieve the object, according to the present invention, there is provided means for detecting a claim phenomenon and operation efficiency reduction phenomenon by collation with data of operation performed actually by the group-controlled system to obtain improvement measures.

The improvement measures involve means relating to an operation specification of a plurality of elevators as a group, for example, means for operating an elevator being at a standstill, and means relating to an operation specification of each of the elevators, for example, means for invalidating a door closing button of an elevator car stopping at a starting floor in order to suppress the elevator car from starting with only a small number of guests getting in or being accommodated in the elevator car.

In addition, there is provided improvement confirmation means for confirming that the phenomena have been improved by the improvement measures and other new claim phenomenon and operation efficiency reduction phenomenon do not occur. There is provided advisability determining means for determining whether the improvement measures are implemented or not.

Further, in order to make the improvement more efficiently, there are provided origin detection means for detecting origins of the claim phenomemon and the operation efficiency reduction phenomenon on the basis of operation data and factor estimating means for estimating a factor upon estimation of assignment causing the origin or upon operation.

In order to provide the group-controlled elevator system which prevents occurrence of a claim from a user, the above means are operated in combination if necessary.

Information relating to elevator cars and elevator halls is sampled at a sufficiently short period to collect and record the information by operation data recording means.

Phenomenon detection means comprises collected phenomenon detection subroutines for detecting individual claim phenomena, operation efficiency reduction phenomena and phenomena representative of an indication of a phenomenon (hereinafter also referred to as phenomena to be improved generically).

Alternatively, the phenomenon detection means uses a phenomenon detection knowledge base including collected knowledge which expresses a name of the claim phenomenon and the operation efficiency reduction phenomenon reported to a design and maintenance department so far and a detection condition from the operation data thereof by the following expression and compares the operation data and the detection condition of the phenomenon by backward inference to detect a phenomenon to be improved.

if (detection condition)-then (phenomenon name).

Alternatively, the phenomenon detection means uses a neural network which is supplied with operation data and produces occurrence of the claim phenomenon and the operation efficiency reduction phenomenon to detect the phenomenon to be improved.

An origin knowledge base comprises collected knowledge for detecting possible assignment or operation of an origin causing the claim phenomenon and the operation efficiency reduction phenomenon on the basis of recorded operation data and expressed by if (possible origin)-then (phenomenon name).

When there are a plurality of origins causing the phenomenon, the knowledge is expressed by if (possible origin 1)-then (phenomenon name)

if (possible origin 2)-then (phenomenon name)

if (possible origin 3)-then (phenomenon name)

if ( . . . )-then ( . . . ).

The origin detection means detects whether assignment or operation which is inferred as a possible origin from the knowledge of origins is actually implemented or not by the backward inference on the basis of operation data.

A factor knowledge base comprises collected knowledge for inferring a factor causing a detected possible origin from recorded operation data and expressed as follows.

if (possible origin)-then (possible factor).

The factor estimating means infers a factor (a prediction method, control method, various setting conditions and the like) inferred from factor knowledge by the forward inference on the basis of operation data.

Improvement measure preparing means uses an improvement measure table in which phenomenon improvement methods performed in the past are recorded, in order to improve a detected phenomenon, so that improvement measures are prepared. Alternatively, the improvement measure preparing means prepares measures for changing an estimated factor or prepares the measures by selection from the improvement measure table.

The improvement confirming means confirms by simulation that when the improvement measure has been implemented, the phenomenon has been improved by the improvement measures and other new claim phenomenon and operation efficiency reduction phenomenon do not occur.

The advisability determining means examines an implementation attribute relating to the improvement measures and produces the improvement measures having an "implementation possible" or that obtained as a result of an inquiry using a conversation type input and output unit in respect to an "implementation inquiry" attribute to improvement implementation means. Further, a report attribute relating to the improvement measures is examined and if it is a "report required" attribute, the improvement measures are produced to an output unit.

A plurality of elevators are group-controlled by group control implementation means on the basis of the improvement measures as obtained above, so that the claim phenomenon and operation efficiency reduction phenomenon can be improved.

BRIEF DESCRIPTION OF THE DRAWINGS

FIG. 3 is a general flow chart showing operation of improving a claim phenomenon or the like;

FIG. 4 is an example of a phenomenon level table 9;

FIG. 5 is an example of an improvement measure table 10;

FIG. 10 is a table showing an example of an improvement measure table in the embodiment;

FIG. 16 is a table showing an example of an improvement measure table 10 including a report attribute added thereto.

DESCRIPTION OF THE PREFERRED EMBODIMENTS

An embodiment of the present invention is described with reference to FIGS. 1 to 8.

Figure 1:
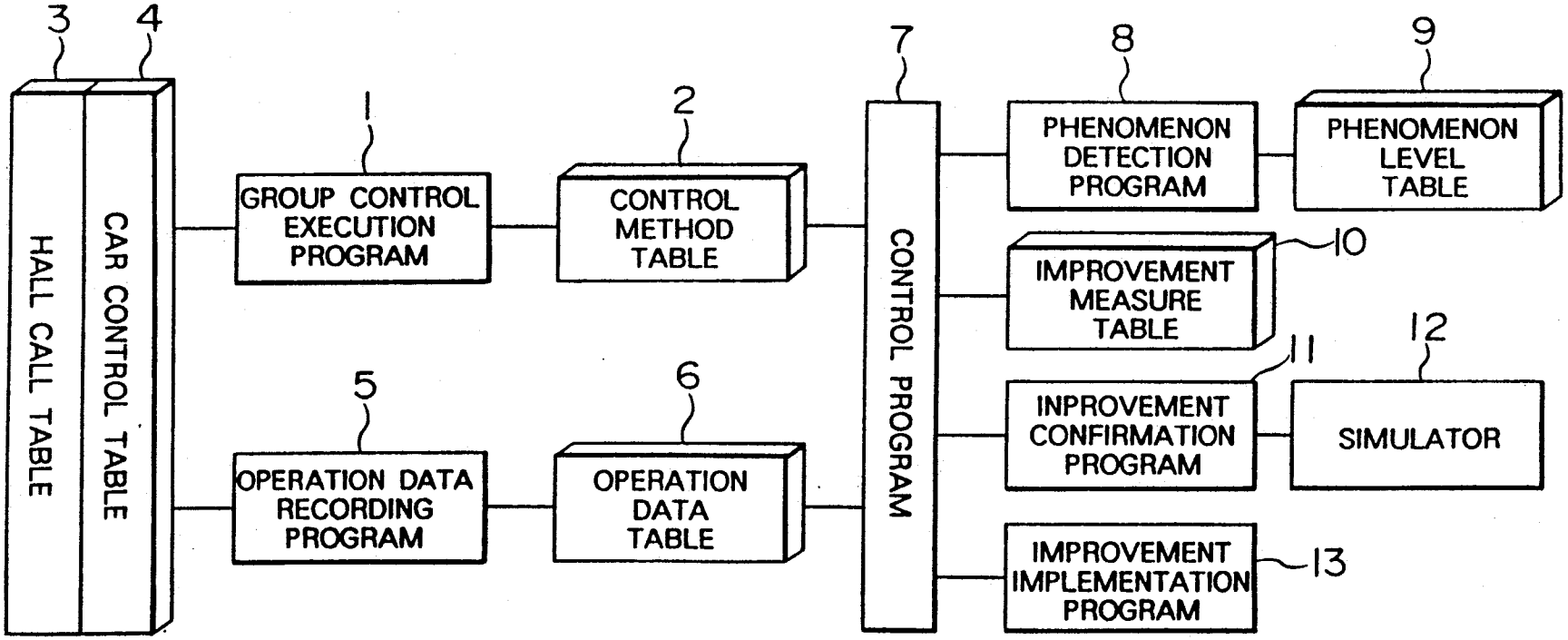
FIG. 1 is a block diagram showing the overall configuration of software in an embodiment of the present invention.

FIG. 1 is a block diagram showing the whole configuration of software according to an embodiment of the present invention. In the embodiment, it is assumed that a hardware system thereof comprises a first microcomputer for implementing a group control execution program 1 and an operation data recording program 5 and a second microprocessor for implementing a control program 7 to an improvement implementation program 13. However, the hardware system is not limited thereto but the whole hardward system may be configured by a single microcomputer; or it may be configured a plurality of parallelly-operated microcomputers, each for some programs. Further, even if the whole programs are provided in a group-controlled apparatus, or even if the control program 7 to the improvement implementation program 13 are provided separately from the group-controlled apparatus, the present invention can attain the same effects.

In FIG. 1, the group control execution program 1 including the group control execution means executes group control for signals of a hall call table 3 and an elevator car control table 4 by a control method of a control method table 2. A process in the group control execution program 1 can utilize known various methods in, for example, Japanese Patent No. 1150639 and the like and accordingly detailed description thereof is omitted. The control method table 2 stores various prediction methods, control methods, setting conditions, parameters and specification values used in the group control execution program 1. Further, the hall call table 3 stores a call signal of each hall and the car control table 4 stores a current position and a load of each elevator car and a call signal assigned to each elevator car.

The operation data recording program 5 including the operation data recording means samples and collects signal information of the hall call table 3 and the elevator car control table 4 at intervals of a short period (in the embodiment, at intervals of one second) to records the signal information in an operation data table 6. A process in the operation data recording program 5 can utilize a known method in, for example, Japanese Patent Unexamined Publication No. 61-90977 and the like and accordingly detailed description thereof is omitted. The operation data table 6 comprises a memory medium such as an RAM, a hard disk or a write type optical disk and holds operation data during a fixed period (in the embodiment, one month).

Processes in the group control execution program 1 and the operation data recording program 5 are made for occurrence of hall calls and operation of elevator cars in real time.

The control program 7 controls the progress of programs and contents of data tables illustrated by 8 to 13 and including a core of the present invention and controls input and output of data to the control method table 2 and the operation data table 6.

Referring now to FIGS. 2 to 8, the procedures of the detection and the improvement of the phenomenon to be improved are described.

Figure 2:
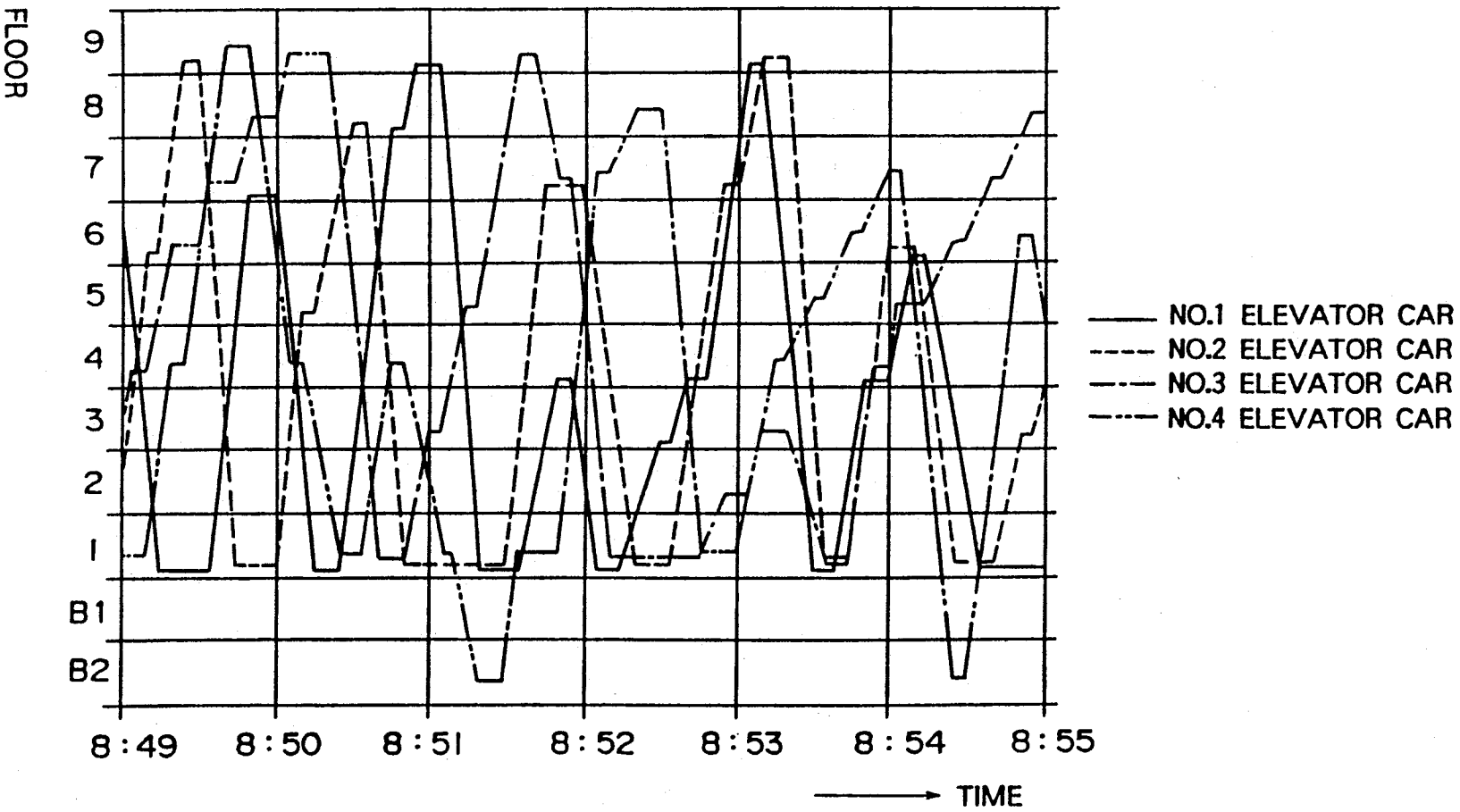
FIG. 2 PRIOR ART
FIG. 2 is a diagram showing operation of elevators in the office-going hour.

FIG. 2 is an operation diagram showing operation data actually measured in a certain building in the office-going hour and in which a diagram plotting time is simplified in five-second unit and hall call information is omitted. In FIG. 2, the first half operation is fairly good, but the second half operation after the time of 8:52:30 is "overlapped". In the succeeding description, the programs are described while taking an improvement of operation shown in FIG. 2 by way of example.

Figure 3:
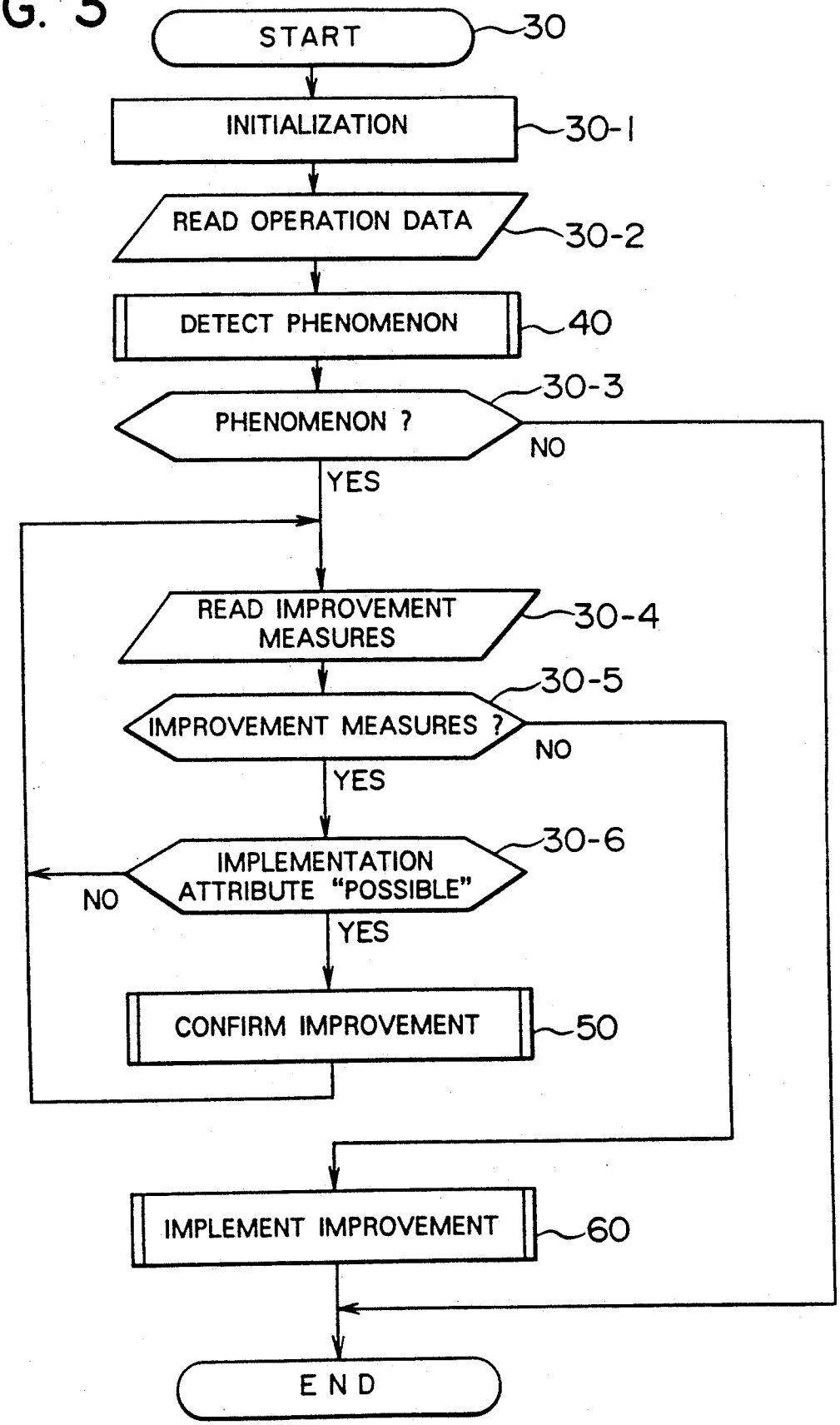

FIG. 3 is a general flow chart showing operation of improving the claim phenomenon or the operation efficiency reduction phenomenon. The control of the flow of the process of FIG. 3 is made by the control program 7, and each individual process is a smaller program unit. Execution is made by programs 8, 11 and 13.

Programs to be hereinafter described are to be divided into a plurality of tasks and to be controlled and executed under a system program performing efficient control, that is, a real time operating system. Accordingly, start and stop of the program are freely made from system time or other program.

The control program 7 performs an initialization process for a feature mode of traffic flow data to be interested (for example, in the office-going hour) and level setting of a phenomenon to be improved (for example, level 1) in step 30-1 shown in FIG. 3. An example of a phenomenon level table 9 representing the current level is shown in FIG. 4. In the phenomenon level table 9, a level is set to a phenomenon to be improved in each feature mode of traffic flow data decided by utilization state of the elevator and a time zone. For example, there are "short shipment", "long average waiting time" and "overlapped operation" as the phenomenon to be improved in the office-going hour and levels representing importance of the phenomena are indicated to be 3, 2 and 1. The importance is higher as the level value is larger.

In step 30-1 of FIG. 3, a level is set from a higher level value.

Then, in step 30-2 of FIG. 3, operation data (corresponding to operation data shown in FIG. 2) of the traffic flow data is read from the operation data table 6.

In subroutine 40, a claim phenomenon or operation efficiency detection phenomenon (for example, overlapped operation) is detected. The contents of this process will be described later.

In step 30-3, whether the phenomenon to be improved is present or not is determined, and when the phenomenon is present, the process proceeds to step 30-4.

In step 30-4, improvement measures for the phenomenon are read from the improvement measure table 10. An example of the improvement measure table 10 is shown in FIG. 5.

The improvement measure table 10 can be considered as a kind of decision table and lists improvement measures performed to improve claims so far on the basis of knowledge and experience of designers and maintenance persons of the elevator. An example of improvement measures for the phenomenon of the level 1 in the office-going hour mode, that is, the overlapped operation is shown.

In FIG. 5, the "invalidation of door closing button" is expressed in the improvement measure column means as the improvement measures for invalidating the door closing button of the elevator car which is waiting at a starting floor for guests or users to enter the elevator car in, suppressing the elevator car from starting with a small number of guests getting in or being accommodated in the elevator car. "Stop once at starting floor" is the improvement measures for forcedly stopping the elevator car at the starting floor and up from the basement in order to ensure that transportation capability of the elevator system is available. "Extension of start restriction timing" is the improvement measures for extending a time counted by a start restriction timer defined in a specification in order to match the time to an actual situation of a building in which the elevator system is installed. "On/off" is a judgment flag which is "Y" when the corresponding improvement measures are of a change-over type in which the improvement measures can be implemented or not, and "N" when is the improvement measures have intermediate steps such as parameter adjustment. An implementation attribute is an attribute representative of advisability as to automatic implementation of the improvement measures. "Implementation impossible" means the improvement measures which can not be implemented by an administrative person's desire of a building or by a specification of the elevator system of the building. "Implemented" means that the corresponding improvement measures have been already implemented when on/off of the improvement measures is "Y" or the improvement measures can not be adopted any more when on/off is "N" and the parameter is set to its limit value. The "implemented" or "implementation impossible" attribute can be set in each building by the maintenance person or the like or by using contents set in a terminal device for an elevator as disclosed in Japanese Patent Unexamined Publication No. 1-231784. When the implementation attributes of all improvement measures are represented by "implemented" and "implementation impossible", this state represents that the improvement is on the boundary thereof.

In step 30-5 of FIG. 3, when there are improvement measures, the implementation attribute of the improvement measures is confirmed in step 30-6. When the implementation attribute of the improvement measures is "implementation possible", its improvement effect is confirmed in subroutine 50.

When the decision in step 30-6 is "NO" or when the subroutine 50 has been completed, the process is returned to step 30-3 and the same process is repeated. At this time, next improvement measures of the last processed improvement measure are read in step 30-4.

In an example of improvement for the overlapped operation, the improvement measures of the "invalidation of door closing button" can not be implemented and the "stop once at starting floor" is already implemented, and both of the improvement measures are excepted in step 30-6. The improvement measures of the "extension of start restriction timing" can be implemented and the process proceeds to the subroutine 50 (described later).

Thereafter, when the above processes for all of the improvement measures have been completed, the judgment in step 30-5 is "NO" and the process proceeds to a subroutine 60. In the subroutine 60, the improvements are implemented on the basis of the improvement effects confirmed in the subroutine 50.

The subroutines 40, 50 and 60 are now described with reference to the drawings.

Figure 6:
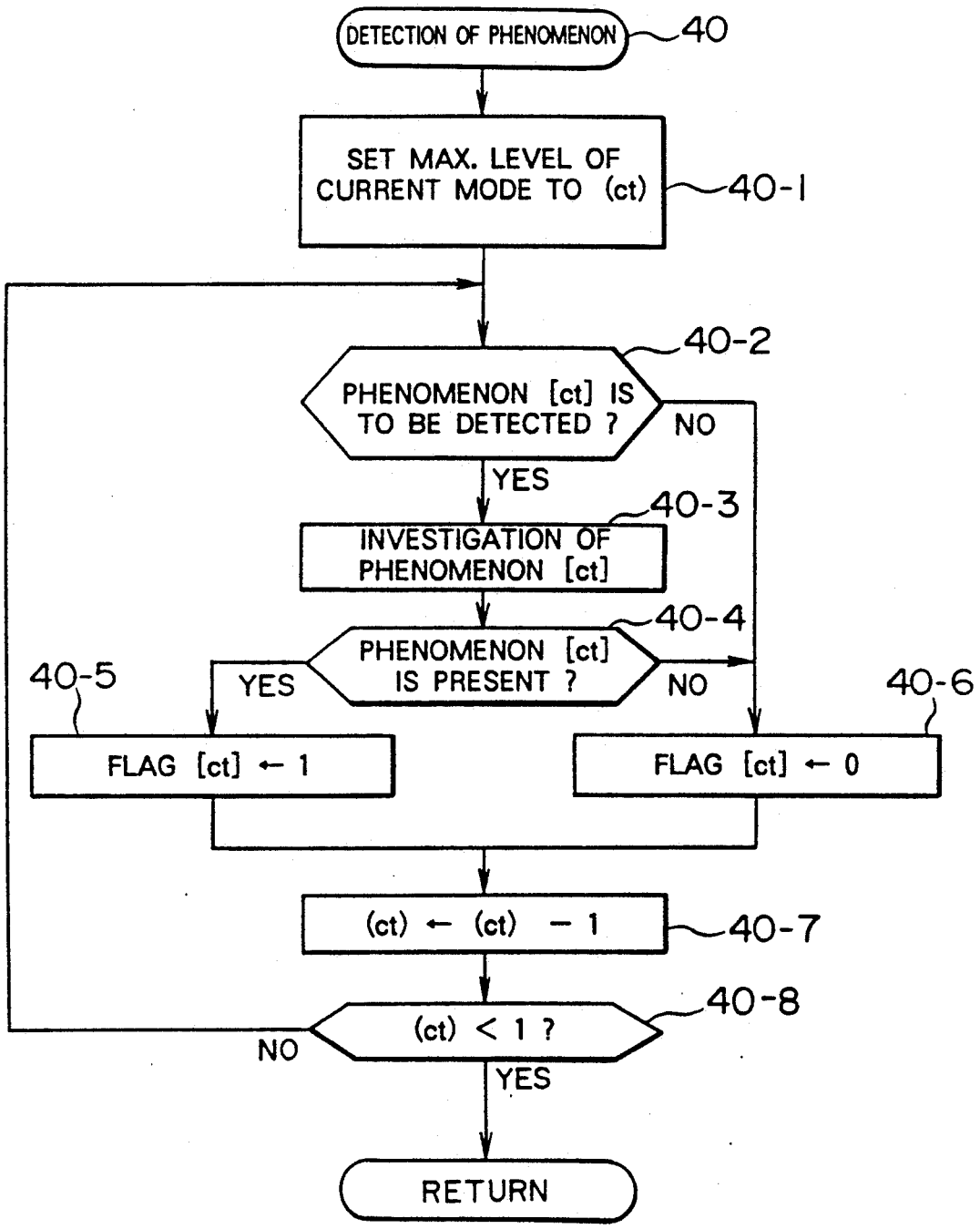
FIG. 6 is a flow chart showing a subroutine of detecting a phenomenon to be improved.

FIG. 6 is a flow chart showing an example of the subroutine 40 for detecting a phenomenon to be improved.

In step 40-1, a maximum level of the current mode is set to a counter variable ct of a loop. In step 40-2, whether a phenomenon of a ct level described later is to be detected or not is examined and if it is to be detected, the phenomenon of the ct level is detected by investigating operation data in step 40-3. The phenomenon [ct] indicates a phenomenon when the level has a ct value. For example, in the office-going hour, the phenomenon [2] is the "long average waiting time", and the phenomenon [1] is the "overlapped operation". Further, since the detection method in the process of step 40-3 is different depending on the phenomenon, a detection function or a detection subroutine corresponding to each individual phenomenon is used. The present invention can be implemented in the same manner by using a phenomenon detecting neural network learned previously. In step 40-4, whether the phenomenon is present or not is examined, and if present, the flag is set to "1" in step 40-5 and if not present, the flag is set to "0" in step 40-6. In step 40-7, the counter ct is updated. In step 40-8, whether the loop is finished or not is checked, and if not finished, the process proceeds to step 40-2 and the same process is repeated.

In the flow chart, the current mode and the current level are specified for the phenomenon to be detected in step 40-2, so that whether the phenomenon to be improved is present or not can be determined. Further, in confirmation of the improvement described later, all levels of the current mode are specified, so that all phenomena to be improved can be detected.

Figure 7:
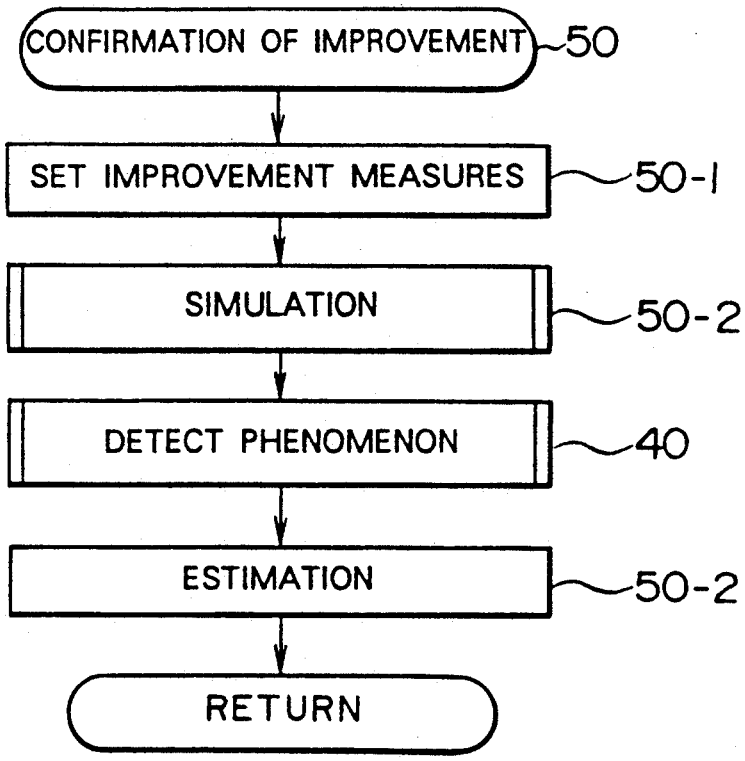
FIG. 7 is a flow chart showing an example of an improvement confirming subroutine 50.

FIG. 7 is a flow chart showing an example of the improvement confirmation subroutine 50.

In step 50-1, the improvement measure is set, and in subroutine 51, appearance situation of guests or passengers in the operation data is utilized to make simulation for the improvement measure. In the embodiment, the improvement measures of "extension of start restriction timing" are taken up, and the start restriction timing is extended, for example, from 15 seconds to 20 seconds to make simulation utilizing appearance passenger information of the recorded operation data. The simulation 51 can use a method disclosed in Japanese Patent Unexamined Publication No. 58-52162. Then, the subroutine 40 is employed to examine whether the phenomenon to be improved is included in the simulation result after implementation of the improvement measure or not. At this time, not only the overlapped operation but also the phenomena to be improved of all levels in the traffic flow mode concerned are detected. Finally, the detection result is estimated in step 50-2.

In the estimation of the detection result, for example, the improvement measures in which all phenomena to be improved are not detected are estimated as "A". When the phenomenon having a level lower than the current phenomenon to be improved is detected, estimation is made as "B", and when the current phenomenon to be improved or the phenomenon having a level higher than the current phenomenon is detected, estimation is made as "C". The improvement measures having the estimation A or B are to be adopted and the improvement measures having the estimation C are not to be adopted. For example, if it is assumed that all phenomena to be improved are not detected as a result of "extension of starting restriction timing" which is the improvement measures in the embodiment, its estimation is "A".

Figure 8:
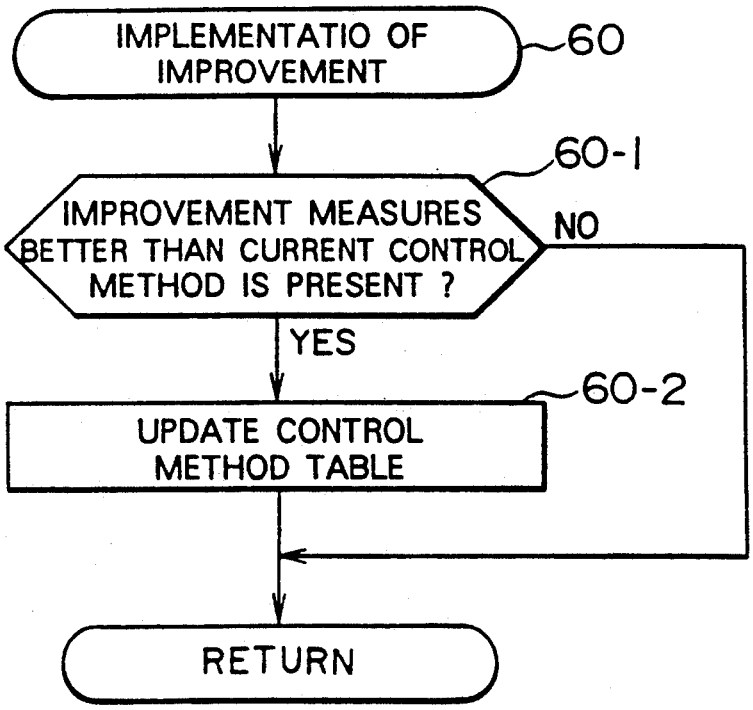
FIG. 8 is a flow chart showing an example of an improvement implementing subroutine 60.

FIG. 8 is a flow chart showing an example of the improvement implementation subroutine 60.

In step 60-1, whether improvement measures (estimation A or B) better than the current control method are present or not is examined from the estimation result. When there is a better control method, contents of a portion concerned of control method table 2 are updated in step 60-2. In the embodiment, since the improvement measures of "extension of starting restriction timing (15 seconds→20 seconds)" are estimated as A, the control method table 2 is updated in step 60-2.

According to the embodiment described above, the following merits are attained.

There can be provided the group-controlled elevator system which effects detection of the phenomenon to be improved and improvement on the basis of knowledge and experience of the designer and the maintenance person of the elevator.

By setting the implementation attribute in the improvement measure table, the improvement measures reflecting the administrative person's opinion can be automatically selected in accordance with utilization state in each building.

By setting a level to the phenomenon to be improved, the phenomenon can be improved in order of importance of improvement. Further, when some phenomena are combined, the phenomena can be improved.

Another embodiment of the present invention is now described with reference to FIGS. 9 to 13.

In the embodiment, the attribute "implemented" or "implementation impossible" is set in each building by the maintenance person or the like or is set by using contents set in a terminal device of the elevator, while when whether the improvement measures are good or bad is judged by a person, there is a case where a selection is made so that the improvement measures are not adopted when the degree of improvement is small and the measure is adopted when the measures are very effective. When the setting is made by the terminal device of the elevator opened to the administrative person of the building, there are considered setting of a control method which is difficult to be adopted clearly, setting having no problem particularly, and setting having a standard value which is not understood sufficiently. It is considered that the setting which is adopted depending on the degree of improvement and the setting which is not understood sufficiently are determined in a conversation manner with the group-controlled elevator system.

The embodiment described below comprises advisability determining means in addition to the above-mentioned embodiment and realizes determination in the conversation manner with the group-controlled elevator system.

Figure 9:
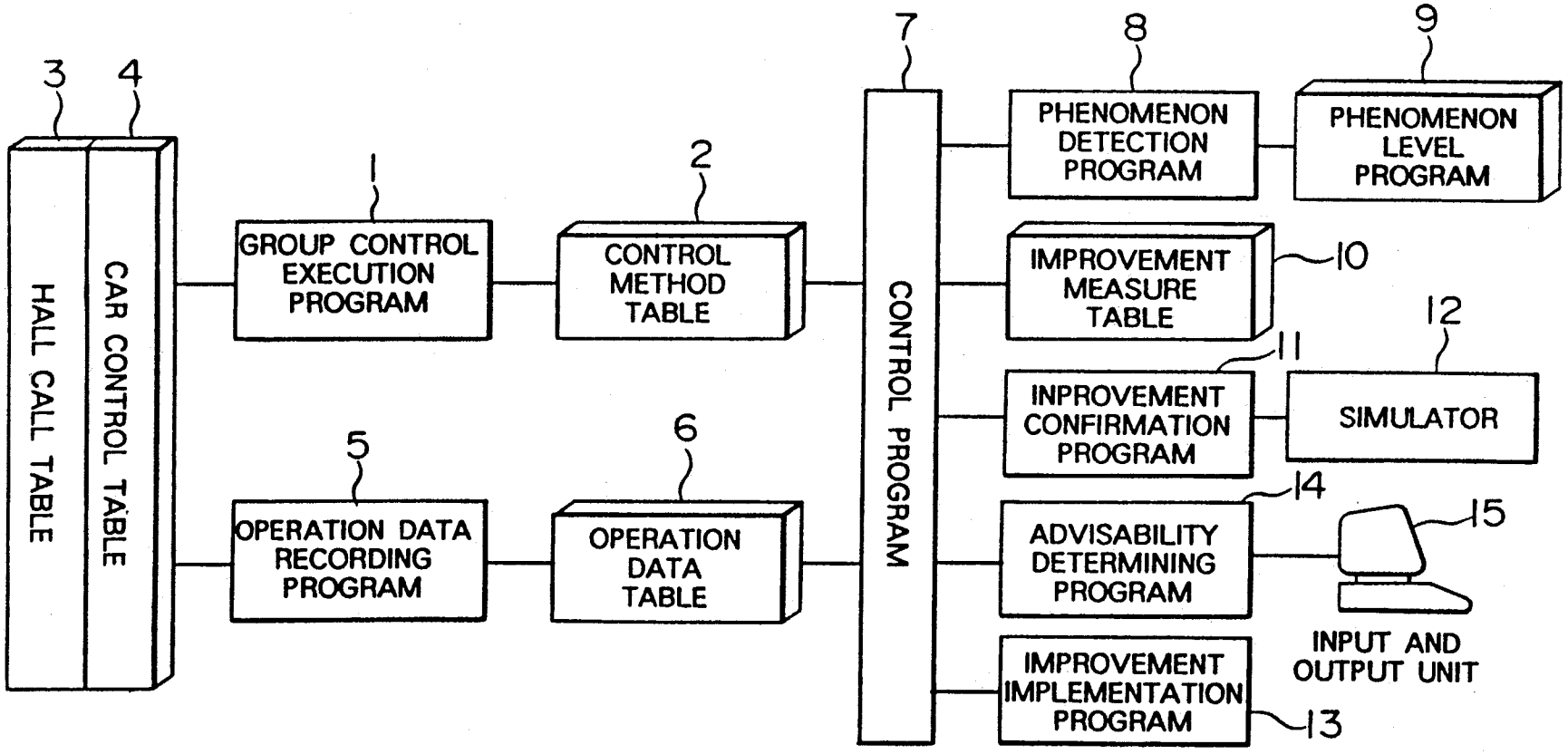
FIG. 9 is a block diagram showing the whole configuration of softwares in another embodiment of the present invention.

FIG. 9 is a block diagram showing the whole configuration of softwares of the embodiment.

The embodiment of FIG. 9 is different from the embodiment shown in FIG. 1 in that an advisability determining program 14 and an input and output unit 15 are added.

FIG. 10 is an example of the improvement measure table. "Inquiry" is added to the implementation attribute and there are four attributes. In the building of this example, the "invalidation of door closing button" is set to "implementation impossible" since it had a bad reputation from the users when it was adopted before, the "stop once at starting floor" is set to "implementation inquiry" since it may be set depending on the degree of effect thereof, and the "extension of start restriction timing" is set to "implementation possible". The setting of the implementation attribute is made freely in the building.

Figure 11:
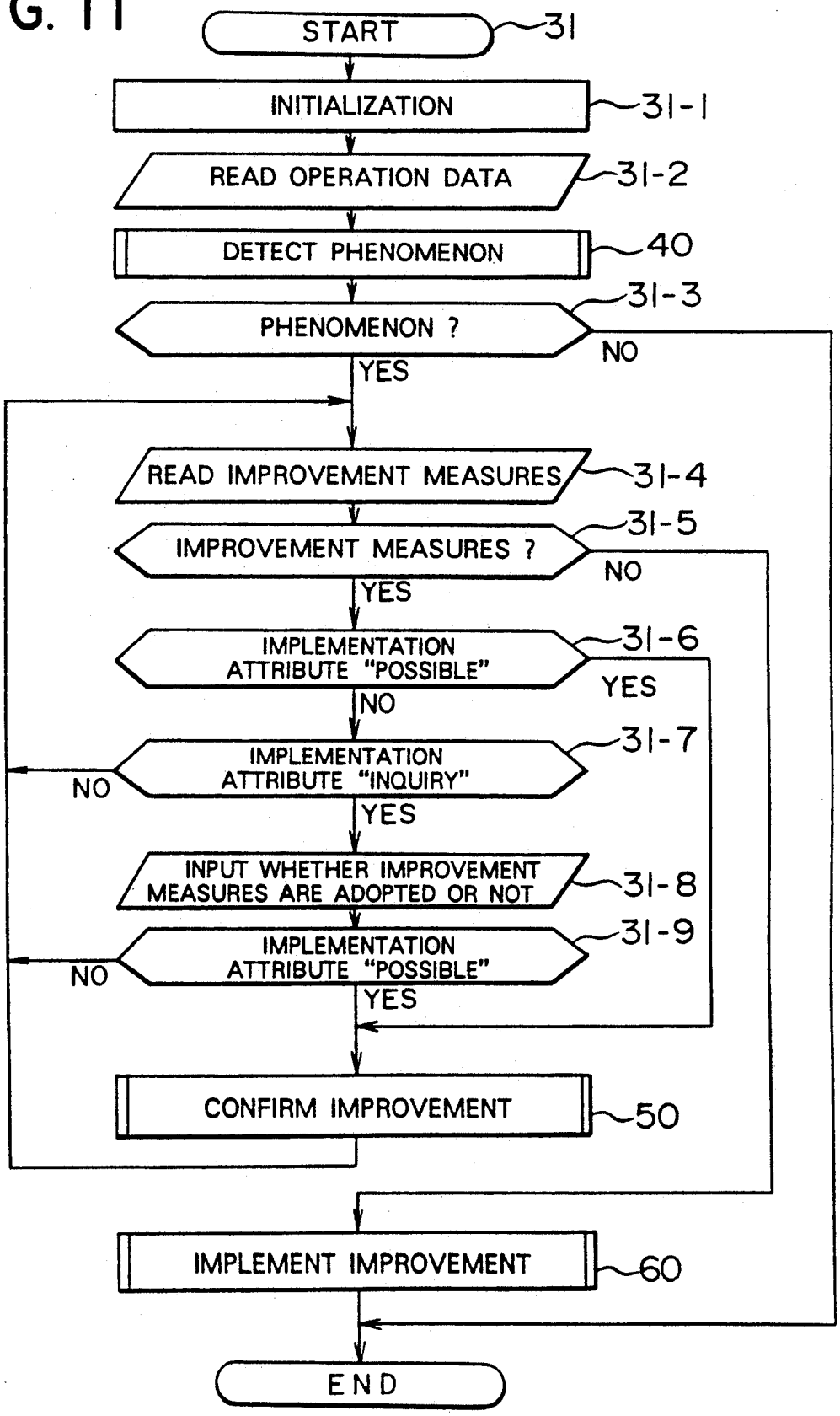
FIG. 11 is a flow chart showing an example of operation including advisability determining means.

FIG. 11 is a flow chart showing an example of operation of the system including the advisability determining means.

Processes until step 31-6 are the same as those until step 30-6 of FIG. 3. When decision is "NO" in step 31-6, whether the implementation attribute is "inquiry" or not is confirmed in step 31-7. When the attribute is the "inquiry", the improvement measures are exhibited to the maintenance person of the elevator or the administrative person of the building to obtain an input as to whether the improvement measures are adopted or not. In step 31-9, when the input result is "possible", the process proceeds to the improvement confirmation subroutine 50. The subsequent process is the same as in FIG. 3.

According to the embodiment, since the improvement confirmation process is made only to the improvement measure having the implementation attribute which is "improvement possible" or the inquiry result which is "possible", the time necessary for the improvement can be made short.

The input and output unit 15 can be utilized for not only input of determination of the advisability as to the implementation of the improvement measures but also input of the improvement measure itself.

For example, in step 50, when the improvement measures are the "extension of start restriction timing", simulation is made by extending the current start restriction timing from 15 seconds to 20 seconds. However, it is assumed that this improvement measures are not effective (refer to FIG. 7). Further, it is assumed that the upper limit of the start restriction timing in the improvement measure table is 20 seconds. Thus, the improvement measures that the start restriction timing is increased to 25 seconds are written into a blank of the improvement measure table by the input and output unit 15 and simulation is made. Consequently, if the detection result is estimated as "A", the "extension of start restriction timing" having the timing of 25 seconds is set to the improvement measure.

As described above, the improvement measures which are not implemented so far are inputted from the input and output unit and stored, so that occurrence of the claim phenomenon and the operation efficiency reduction phenomenon can be prevented.

Figure 12:
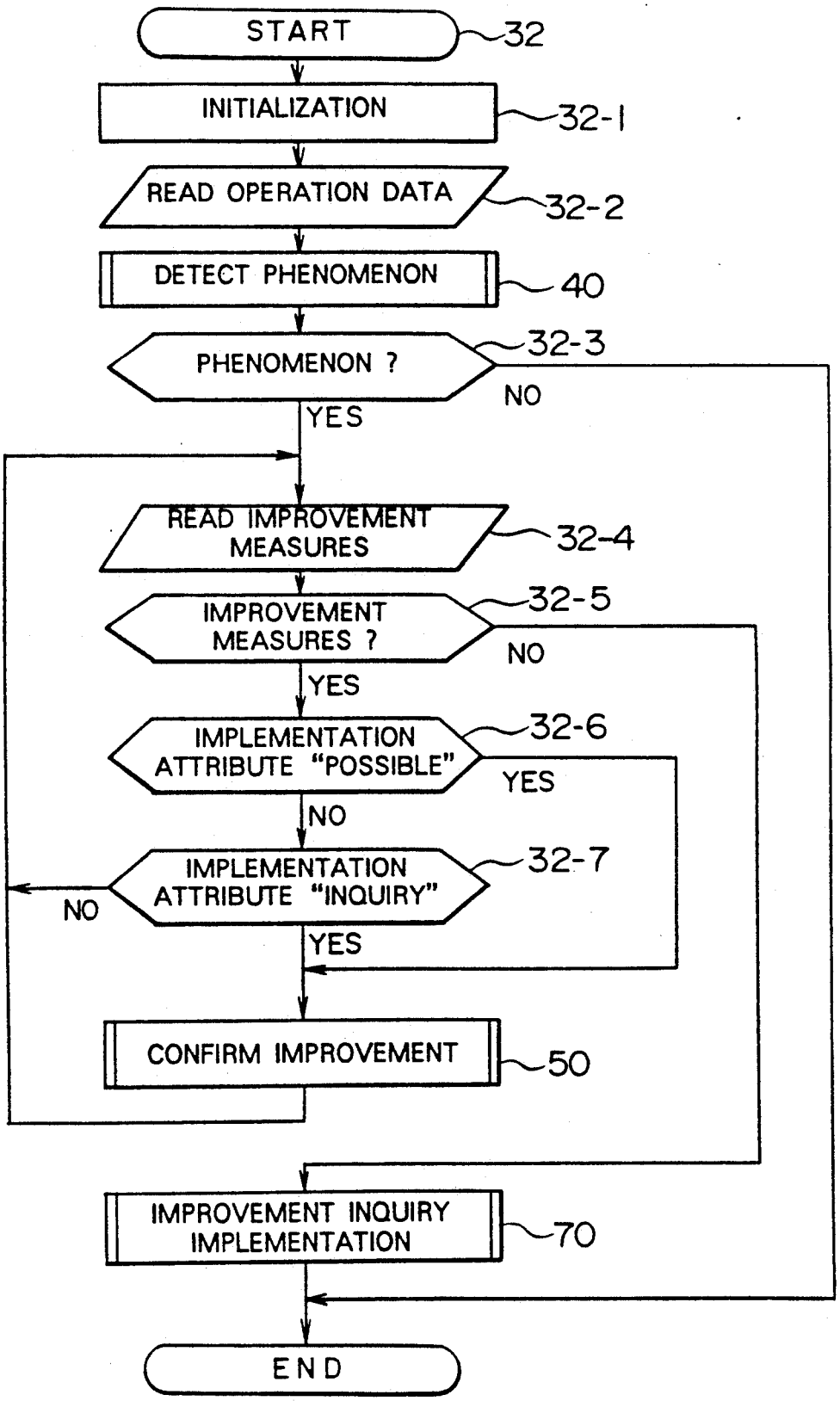
FIG. 12 is a flow chart showing another example of operation including advisability determining means.
Figure 13:
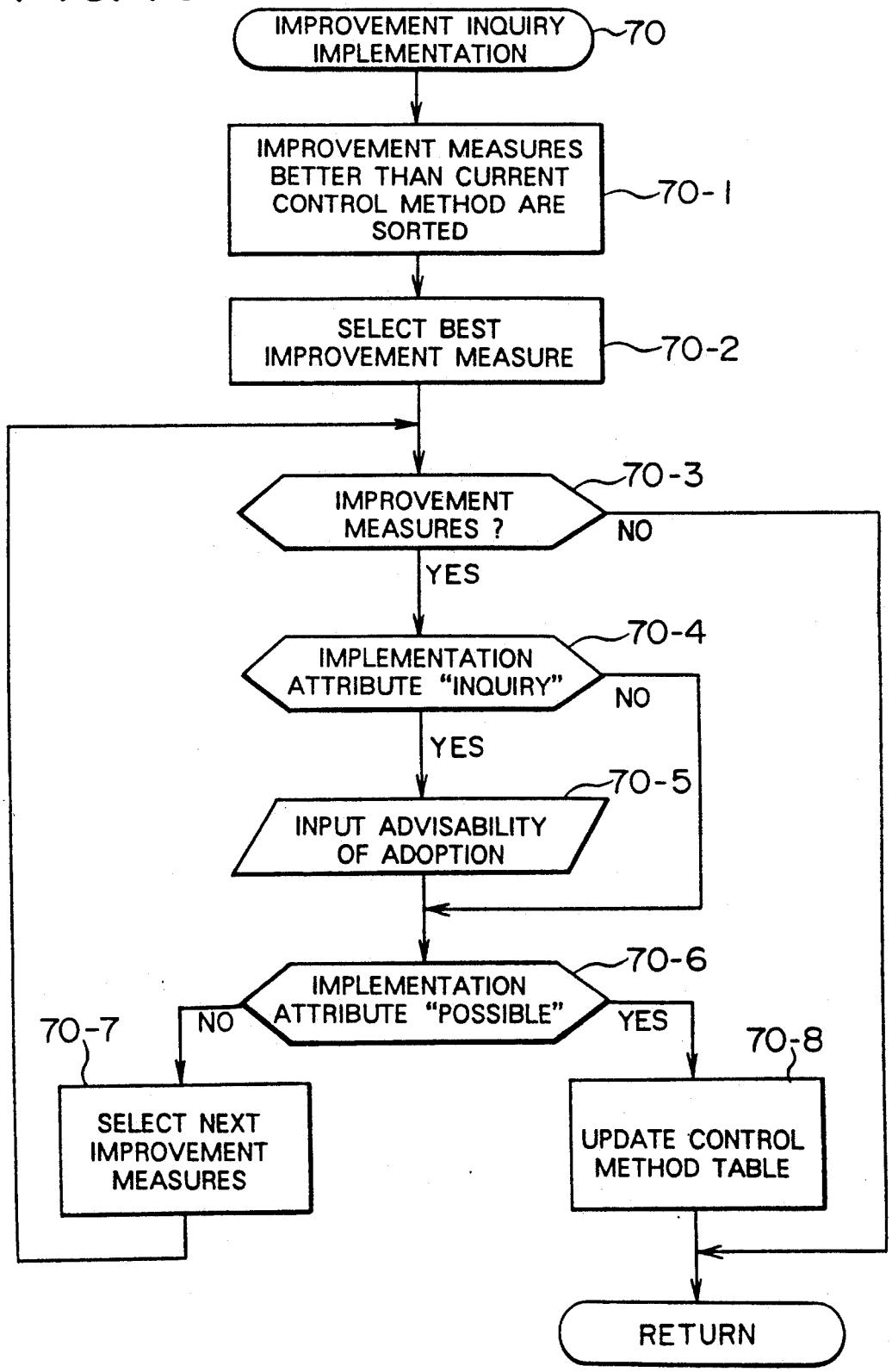
FIG. 13 a flow chart showing an example of an improvement inquiry implementation subroutine 70.

Still another embodiment using the "implementation inquiry" attribute is shown in FIGS. 12 and 13.

FIG. 12 is a flow chart showing an example of operation of the system including the advisability determining means.

Processes until step 32-6 are the same as those until step 30-6 of FIG. 3.

In step 32-6, when decision is "NO", whether the implementation attribute is the "inquiry" or not is confirmed in step 32-7. When the attribute is the "inquiry", the process proceeds to the improvement confirmation subroutine 50 in the same manner as in the "implementation possible" attribute. Thereafter, when the above process for all of the implementation measures has been completed, decision in step 32-5 is "NO" and the process proceeds to the improvement inquiry implementation subroutine 70. In the subroutine 70, implementation of the inquiry and the improvement is made on the basis of the improvement effect confirmed in the subroutine 50.

FIG. 13 is a flow chart showing an example of the improvement inquiry implementation subroutine 70.

In step 70-1, improvement measures with simulation results having estimation higher than the current control method (estimation A or B) are sorted in order of the estimation. In this case, the improvement measures having the same estimation may be arranged in order on the basis of an average waiting time or the like. In step 70-2, a best improvement measure is selected from the sorted results. If there is no improvement measure better than the current control method, the process terminates in step 70-3. If there is an improvement measure better than the current control method, the process proceeds to step 70-4. In step 70-4, the implementation attribute of the improvement measures is examined, and if it is the "inquiry" attribute, the improvement measures are exhibited to the maintenance person of the elevator or the administrative person of the building in step 70-5 and advisability of adoption thereof is inputted. In step 70-6, if it is not the "implementation possible" attribute, next improvement measures are selected from the sorted results in step 70-7 and the processes of steps 70-3 et seq. are repeated. In step 70-6, if it is the "implementation possible" attribute, contents of the portion concerned in the control method table 2 are updated.

According to the embodiment, the following merits are attained.

By performing the conversation type process with the group-controlled elevator system, better improvement measures can be selected by using the simulation result with respect to setting which is adopted depending on the degree of improvement or setting which is not understood as to how the setting is made.

There is obtained the system which necessarily adopts the improvement measures having an answer of the implementation "possible" as a result of inquiry to the maintenance person of the elevator or the administrative person of the building as to whether the improvement measure is adopted or not.

Further, the system can be configured so that the processes until the improvement confirmation are previously made to all of the traffic flow characterized modes and the improvement inquiry implementation process is then made collectively.

A still further embodiment of the present invention is now described with reference to FIGS. 14 and 15.

In the above embodiments, the improvement measures for the phenomena to be improved are configured as the improvement measure table, while there are the improvement measures having large effect and the improvement measures having small effect for the same phenomenon to be improved in accordance with its origin or cause. For example, the method using the "invalidation of door closing button" is effective when the door closing button is often operated and the overlapped operation is caused due to the operation of the door closing button, while the method is not effective in the building in which the operation of the door closing button is few.

In the embodiment described below, there is described the group-controlled elevator system in which after detection of a phenomenon to be improved, an origin or cause of the phenomenon is detected and a factor in setting of a control method relating to the cause is further estimated, so that the phenomenon is improved by changing the factor.

Figure 14:
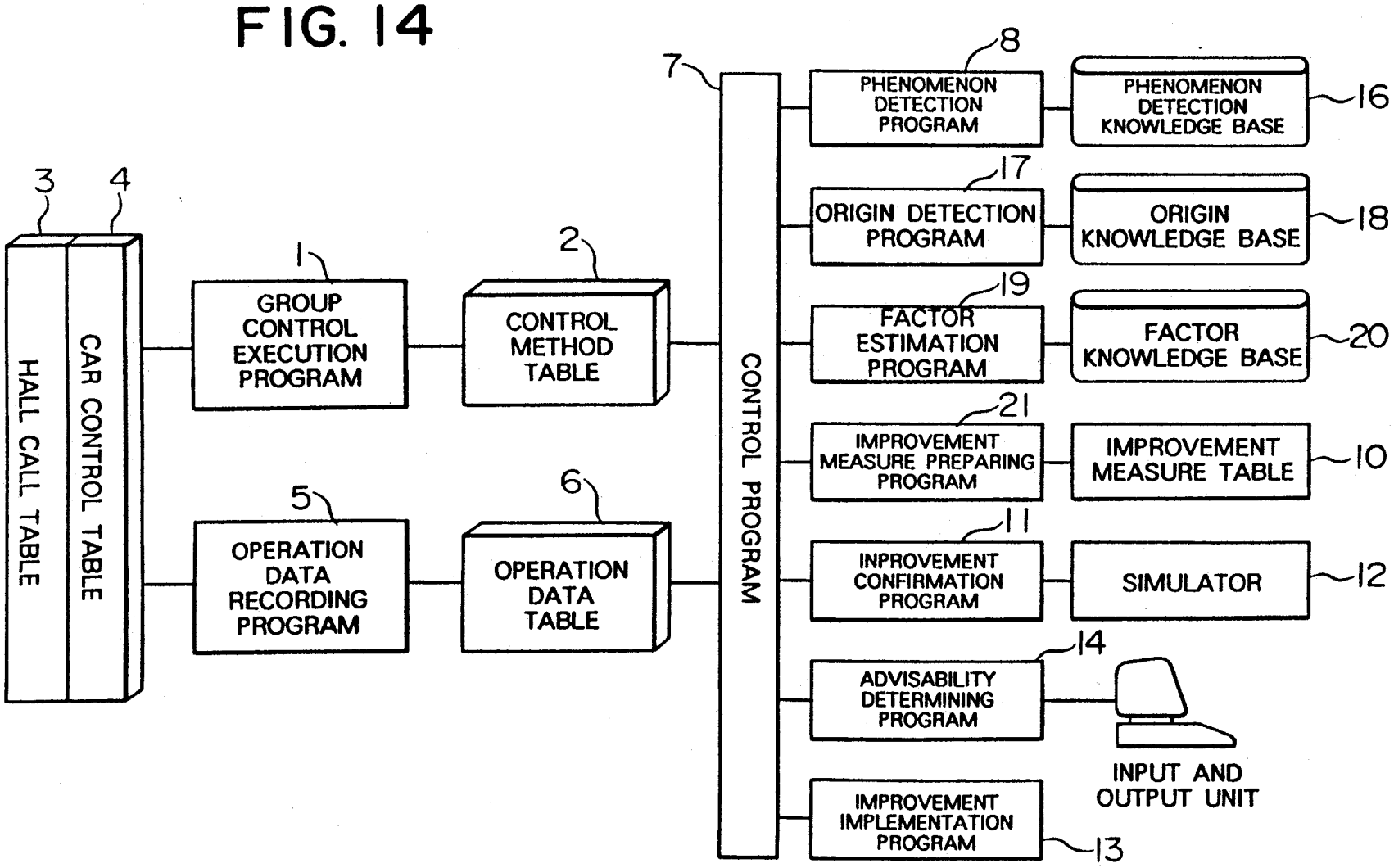
FIG. 14 is a block diagram showing the whole configuration of softwares in still another embodiment of the present invention.

FIG. 14 is a diagram showing the whole configuration of softwares of the embodiment.

The software configuration is different from that of FIG. 9 in that a phenomenon detection knowledge base 16, an origin detection program 17, an origin knowledge base 18, a factor estimation program 19, a factor knowledge base 20 and an improvement measure preparing program 21 are provided newly.

Figure 15:
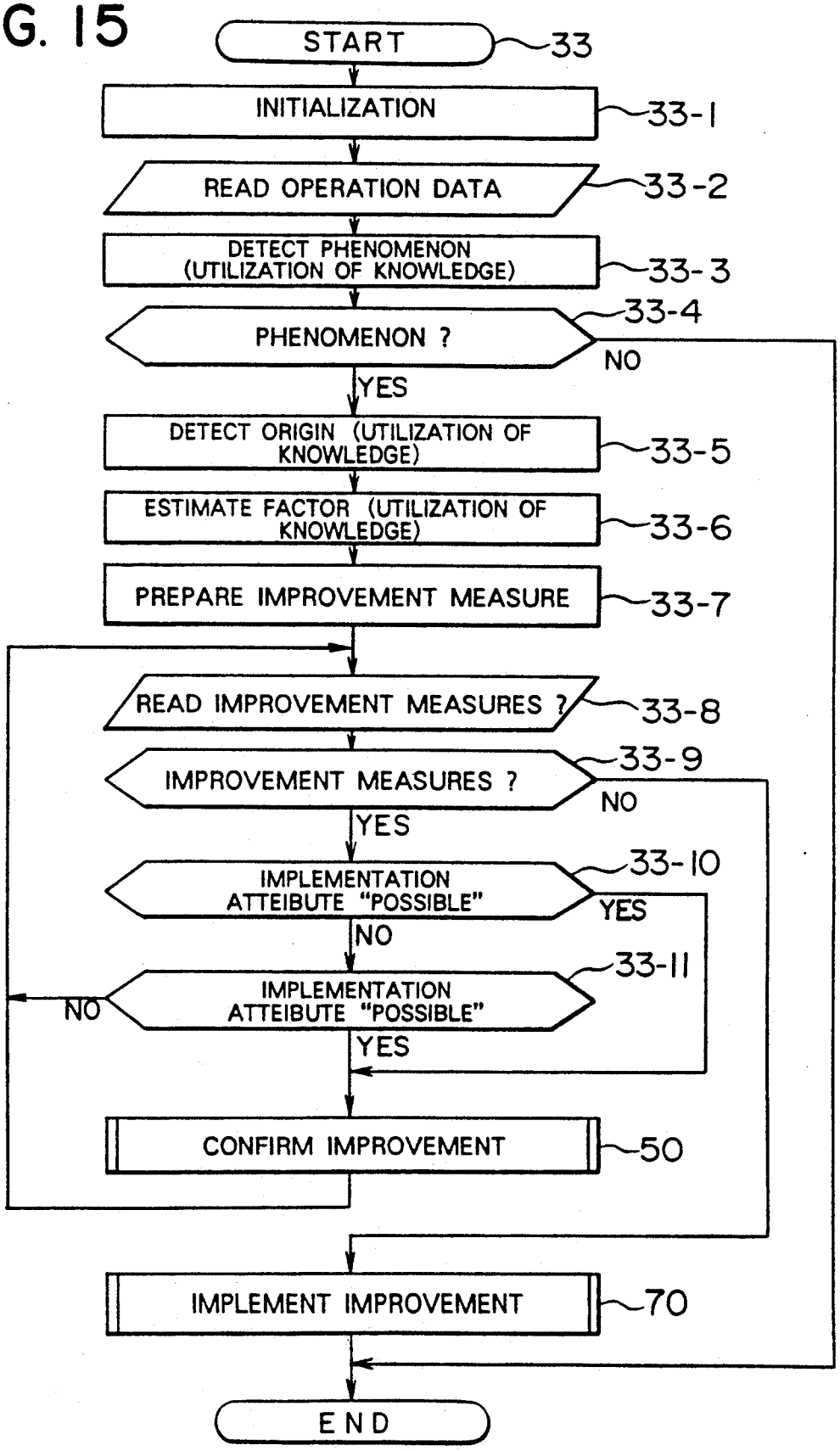
FIG. 15 is a flow chart showing an example of operation using knowledge bases in the embodiment of FIG. 14.

FIG. 15 is a flow chart showing operation of the configuration shown in FIG. 14.

The processes in steps 33-1 and 33-2 are the same as those in step 30-1 and 30-2 of FIG. 3.

In step 33-3, knowledge of the phenomenon detection knowledge base is utilized to detect a claim phenomenon to be improved or an operation efficiency reduction phenomenon.

Phenomenon detection knowledge is described understandably by using the if-then rule. For example, in the office going hour, the knowledge is described as follows.

Rd1: if (occurrence of hall call just after starting with full capacity)-then (short shipment)

Rd2: if (increased overlapped time upon going up)-then (overlapped operation)

Rd3: if (short starting interval of following car)-then (overlapped operation).

A backward inference is applied to the rule to detect a phenomenon to be improved. The backward inference used herein and a forward inference used in a process described later can be realized by using, for example, a general purpose expert system tool "ES/KERNEL" of Hitachi Co. Ltd., and hence its detailed description is omitted. Further, a portion of "overlapped time upon going up" in the if-section of the rule Rd2, for example, is detected from operation data by using a detection function of the overlapped time, various detection subroutine or the like. Terms "just", "increased", "short" or the like can be judged by describing the membership function by setting of suitable numerical value or application of the fuzzy theory.

When the phenomenon detection knowledge is applied to the operation data shown in FIG. 2, the overlapped operation of Nos. 1 and 2 elevator cars from a time of 8:52:30 is detected by the rule Rd2 and the overlapped operation of Nos. 1, 2 and 3 elevator cars from a time of 8:53:30 is detected by the rules Rd2 and Rd3.

In step 33-4 of FIG. 15, whether a phenomenon to be improved is present or not is judged and when the phenomenon is present, the process proceeds to step 33-5.

In step 33-5, knowledge of the origin knowledge base is utilized to detect assignment or operation of an origin causing the detected phenomenon to be improved.

The origin knowledge is described as follows, if the phenomenon is the overlapped operation.

Ro1: if (start from reference floor with light load)-then (overlapped operation)

Ro2: if (door closing button is operated)-then (overlapped operation)

The backward inference is applied to the above rules, so that the operation of the origin is detected. The rules are applied to operation data and the rule having the if-section which is satisfied by operation data is the effective rule.

When the rule is applied to actual operation data, the overlapped operation from the time of 8:52:30 is caused by the starting with light load (Ro1) of No. 2 elevator car started later and the overlapped operation from the time of 8:53:30 is caused by operation of the door closing button in Nos. 2 and 3 elevator cars. At this time, Nos. 2 and 3 elevator cars are started with the light load. That is, when several origins are combined, the origins can be detected by using the origin knowledge.

In step 33-6, knowledge of the factor knowledge base is utilized to estimate a factor in a control method realizing the assignment or operation of the detected origin.

The factor knowledge is described as follows.

Rf1: if (start from reference floor with light load)-then (start restriction timing is short)

Rf2: if (door closing button is operated)-then (door closing button is effective).

The forward inference is applied to the rule to detect the factor. In this example, since the rules Ro1 and Ro2 are effective from the origin detection result, the rules Rf1 and Rf2 are both effective. However, in the operation data having no operation of the door closing button, it is estimated that the rules Ro2 and Rf2 are not effective.

In step 33-7, improvement measures for changing the estimated factor are prepared with reference to the improvement measure table 10. For example, the improvement measures for the "start restriction timing is short" are the "extension of start restriction timing", and the improvement measures for the "door closing button are effective" is the "invalidation of door closing button". As a result of the above described process, the improvement measures for the phenomenon to be improved can be prepared. At this time, a plurality of improvement measures may be prepared possibly, while any improvement measures are prepared on the basis of the origin and the factor and is effective. Further, when the rules Ro2 and Rf2 are not effective, the improvement measures "invalidation of door closing button" are not selected.

The processes in step 33-8 et seq. are the same as those in step 32-4 et seq. of FIG. 12.

According to the embodiment, provision of means for estimating the origin of the phenomenon to be improved and the factor in the control method thereof can avoid selection of ineffective improvement measures and can restrict the improvement measures which are subjected to the improvement confirmation process to the measures having high efficiency.

In the embodiment, description has been made to an example in which the knowledge base divided by functions of the phenomenon detection, the origin and the factor is used, while even if knowledge is expressed using the frame expression, the present invention can be achieved. The frame expression is expressed, for example, as follows.

Frame: overlapped operation
- Level: office going hour level 1
- Detection: large overlapped time upon going up
- Origin: start from reference floor with light load
- Factor: start restriction timing is short
- Improvement measures: extension of start restriction timing
- Implementation: possible
- Adoption or rejection: adoption
- Report: not required.

The expression means that "the overlapped operation is detected when the (overlapped time upon going up is large) in the phenomenon of the (level 1 in the office going hour) and its origin is the (start from the reference floor with light load). The factor in the control method is that the (start restriction timing is short) and its improvement measures are to (extend the start restriction timing). The improvement measures are (possible) and is (adopted). The report is (not required)".

Further, there is a case where a phenomenon caused by abrupt demand or a phenomenon caused by lack of transportation capability of the elevator exceeds limitation of improvement.

When such a phenomenon caused by, for example, the abrupt demand occurs, the following origin knowledge is added Ro3: if (number of passengers exceeds limitation of learned data)
— then (change of reservation is increased)

and the following factor knowledge is added.

Rf3: if (number of passengers exceeds limitation of learned data)
— then (abrupt demand)

The limitation of the learned data can be determined from an average value and a variance statistically.

Further, with regard to the lack of transportation capability, limitation of automatic improvement can be judged by incorporating the following origin knowledge Ro4: if (prediction value of other elevator car exceeds that of assigned elevator car)
— then (average waiting time is long)

and the following factor knowledge

Rf4: if (prediction value of other elevator car exceeds that of assigned elevator car)
— then (transportation capability is lacking)

When the factor is estimated to be the abrupt demand or the lack of transportation capability, preparation of the improvement measures can be finished, so that useless time required for the improvement can be eliminated.

In addition, the claim phenomenon to be improved or the operation efficiency reduction phenomenon has no factor in the control method but possibly has a factor in the utilization method of the elevator. For example, there is a case where a user who has reserved an upward hall call at an upper floor of a building gets in an arrival elevator car and the user then makes a downward request. Consequently, there occurs a large difference between the prediction operation and the actual operation and this is an origin for a claim such as "change of reservation is increased" or "waiting time is long".

With regard to such phenomena, there can be added the following origin knowledge Ro5: if (call of wrong direction is reserved)-than (change of reservation is increased)

and the following factor knowledge

Rf5: if (call of wrong direction is reserved)-then (utilization method has problem).

Thus, futility of time to improve the phenomenon having no factor in the control method can be prevented.

Figure 17:
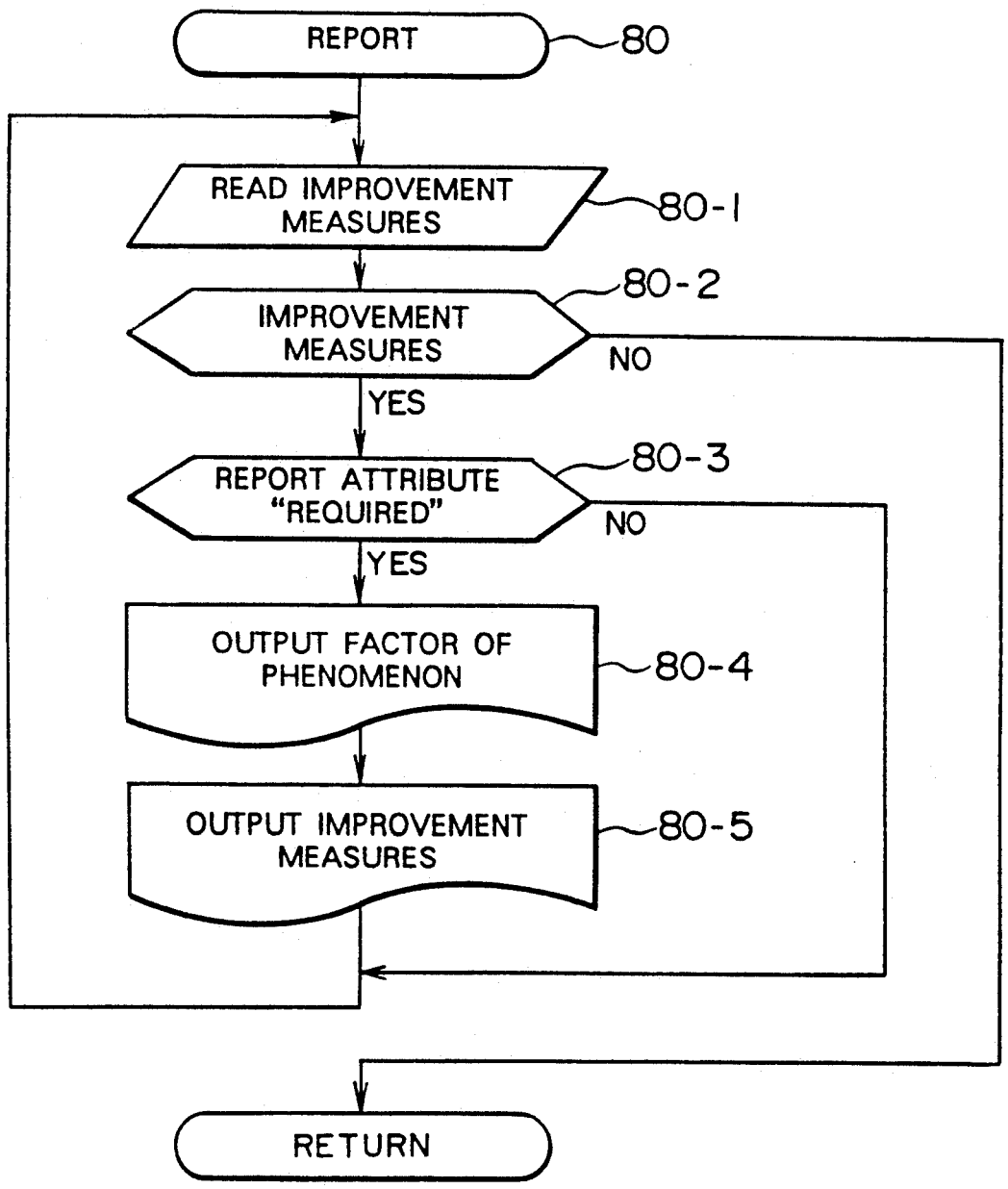
FIG. 17 is a flow chart showing an example of a report subroutine 80.

FIGS. 16 and 17 shows an embodiment taking a case where there is no factor in the control method into consideration.

FIG. 16 is an example of the improvement measure table in which a report attribute is added. The improvement measures "invalidation of door closing button" and "stop once at starting floor" relating to the utilization method of the elevator by the user have the report attribute set to "required", while the improvement measures "extension of start restriction timing" relating to rationalization of a specification value of the group-controlled apparatus have the report attribute set to "not required". At this time, "invalidation of door closing button" has the implementation attribute "impossible", while since there is a case where improvement is made by education of the user through the administrative person of the building in respect to an origin thereof as described later, the report attribute thereof is set to "required". In this manner, the report attribute can be set independently of the implementation attribute.

FIG. 17 is a flow chart of a report subroutine 80.

The report subroutine 80 is incorporated into a next step of the improvement inquiry implementation subroutine 70 of FIG. 15. The report is outputted through the input and output unit 15 or a printer to the maintenance person of the elevator or the administrative person of the building.

In step 80-1, improvement measures are read. In step 80-2, if there is no implementation measure, the subroutine is finished. If there are implementation measures, the report attribute is examined. If the report attribute is set to "required", the process proceeds to step 80-4. Information relating to an origin and a factor of the phenomenon is outputted in step 80-4.

The output is, for example, as follows:

| |
|---|
| "(The overlapped operation)<br>is caused by the origin of (the operation of door closing button) and<br>its factor is setting of (validation of door closing button)". |

In this output, words enclosed by parentheses are changed by a phenomenon. Then, in step 80-5, information of improvement measures for the phenomenon is outputted, for example, as follows:

| |
|---|
| "Improvement measure" includes setting of (invalidation of door closing button).<br>This improvement measures are (not) adopted." |

Then, the process is returned to step 80-1 and next improvement measures are read, so that the same processes are repeated.

Further, as described above, when the origin is "call of wrong direction is reserved" and the factor is "utilization method has problem", the phenomenon can be improved by education of the utilization method by the administrative person of the building on the basis of the report. Typical examples of utilization method having problems are as follows:

| |
|---|
| Wrong operation of a call button for a wheelchair<br>Many use of a door opening button<br>Many use of a door closing button<br>Not getting in or gone away despite call<br>Mischievous call |

According to the embodiment, there can be provided the group-controlled elevator system capable of advising the administrative person of the building about improvement for the operation efficiency reduction phenomenon caused by the utilization method and having no factor in the control method by adding the report attribute to the improvement measures.

The present invention is configured as described above and accordingly the following effects are attained.

There can be provided the group-controlled elevator system which detects the claim phenomenon and the operation efficiency reduction phenomenon from the operation data automatically to prevent occurrence of the claim from the user.

We claim:

1. A group-controlled elevator system, comprising:

means for controlling an operation of a plurality of elevators as a group by control data, means for storing a plurality of improvement measures corresponding to plural inconvenience phenomena including a long waiting time for the operations of elevators, means for detecting said inconvenience phenomena from actual data of said elevators obtained by actual elevator operation, means for selecting one improvement measure from said improvement measures in accordance with the detected inconvenience phenomena, means for confirming whether the detected inconvenience phenomena are improved so as to be less inconvenient by the selected improvement measure, and means for correcting the control data used for the control of said operation of said elevators on the basis of the selected improvement measure, when improvement of the inconvenience phenomena by the selected improvement measure is confirmed.

2. A group-controlled elevator system, comprising:

means for controlling an operation of a plurality of elevators as a group by control data, means for storing a plurality of improvement measure corresponding to plural inconvenience phenomena including a long waiting time for the operation of elevators, means for detecting said inconvenience phenomena from actual data of said elevators obtained by actual elevator operation, means for selecting one improvement measure from said improvement measures in accordance with the detected inconvenience phenomena, means for confirming whether the detected inconvenience phenomena are improved so as to be less inconvenient by the selected improvement measure, means including an interactive type input and output unit for receiving an advisability determination by displaying said improvement measures on said interactive type input and output unit, in accordance with an implementation attribute corresponding to said improvement measure, and means for correcting the control data used for the control of said elevators on the basis of the selected improvement measure, when improvement of the inconvenience phenomena by the selected improvement measure is confirmed.

3. A group-controlled elevator system, comprising, means for controlling an operation of a plurality of elevators as a group by control data, means for storing a plurality of improvement measures corresponding to plural inconvenience phenomena including a long waiting time for the operation of elevators, means for detecting said inconvenience phenomena from actual data of said elevators obtained by actual elevator operation, means for detecting the operation causing the detected inconvenience phenomena, means for estimating a cause of a problem by the operation causing the detected inconvenience phenomena, means for selecting one improvement measure from the plural improvement measures for correcting the estimated cause of the problem, means for confirming whether the detected inconvenience phenomena are improved so as to be less inconvenient by the selected improvement measure, means including an interactive type input and output unit for receiving an advisability determination by displaying said improvement measures on said interactive type input and output unit, in accordance with an implementation attribute corresponding to said improvement measure, and means for correcting the control data used for control of said elevators on the basis of the selected improvement measure, when improvement of the inconvenience phenomena by the selected improvement measure is confirmed.

4. A group-controlled elevator system according to any one of claims 1 to 3, wherein said detecting means for detecting said inconvenience phenomena includes a phenomenon level table having a level set to each of said detected inconvenience phenomena in accordance with one of a degree of necessity or a degree of importance for improvement of said inconvenience phenomena, whereby said inconvenience phenomena are improved in an order of the level.

5. A group-controlled elevator system according to claim 4, wherein said phenomenon level table incudes a plurality of modes, and wherein each of said modes is indicative of traffic flow data corresponding to the elevators determined by time zones in accordance with an utilization state of the elevators.

6. A group-controlled elevator system according to any one of claims 1 to 3, wherein said means for storing improvement measures includes an improvement measure table having a plurality of phenomena and improvement measures corresponding to said inconvenience phenomena.

7. A group-controlled elevator system according to claim 6, wherein said improvement measure table includes an attribute corresponding to implementation of said improvement measures and wherein said attribute is one of implemented, implementation possible and implementation impossible.

8. A group-controlled elevator system according to claim 6, wherein said improvement measure table includes an attribute corresponding to implementation of said improvement measures and wherein said attribute is one of implemented, implementation possible, implementation inquiry and implementation impossible, and wherein said group-controlled elevator system further comprises conversation type input and output means for outputting said improvement measures and determining an advisability of the implementation when said attribute of the implementation of the improvement measures is an implementation inquiry.

9. A group-controlled elevator system according to claim 6, wherein said improvement measure table includes an attribute corresponding to a necessity of report of implementation of the improvement measures and wherein said attribute is one of a report required or a report not required.

10. A group-controlled elevator system according to claim 9, wherein said detecting means further includes output means for outputting said improvement measures from said improvement measure table when said attribute is the report required.

11. A group-controlled elevator system according to any one of claim 1 to 3, wherein said detecting means for detecting said inconvenience phenomena includes a knowledge base including phenomena detection knowledge expressing conditions for detecting said inconvenience phenomenon from the control data by an if-then format rule, and wherein the phenomenon detection knowledge in said knowledge base is collated with the control data to detect said inconvenience phenomena.

12. A group-controlled elevator system according to any one of claim 1 to 3, wherein said selecting means for selecting said improvement measures includes an origin knowledge base including origin knowledge expressing a relation of a phenomenon and an origin by an if-then format rule, origin detection means for detecting an origin causing a phenomenon from the origin knowledge in said origin knowledge base, a factor knowledge base including factor knowledge expressing a relation of a factor causing the origin by said if-then format rule, and factor estimation means for estimating a factor from the factor knowledge in said factor knowledge base.

13. A group-controlled elevator system according to claim 12, wherein said selecting means for selecting said improvement measures further includes means for limiting selection of said improvement measures to improvement measures adopted by the origin detected by said origin detection means.

14. A group-controlled elevator system according to claim 12, wherein said selecting means for selecting said improvement measures obtains said improvement measures by changing the factor estimated by said factor estimation means.

15. A group-controlled elevator system according to any one of claims 1 to 3, wherein said detecting means for detecting said inconvenience phenomena detects a phenomenon to be improved from a neural network having operation data and produces an occurrence of phenomenon.

16. A group-controlled elevator system according to any one of claims 1 to 3, wherein said improvement measures correspond to an improvement of control corresponding to an operation in said group of said plurality of elevators and improvement of operation of each individual elevator of said elevators.

* * * * *